United States Patent [19]

Rönning

[11] 4,125,087

[45] Nov. 14, 1978

[54] APPARATUS FOR CLEANING AND PAINTING GAS BOTTLES

[76] Inventor: Bengt L. Rönning, Sockerbruksg. 13A, 262 00 Ängelholm, Sweden

[21] Appl. No.: 826,360

[22] Filed: Aug. 22, 1977

[51] Int. Cl.[2] ..... B05C 1/02

[52] U.S. Cl. ..... 118/72; 15/56; 15/104.04; 118/232; 118/242

[58] Field of Search ..... 15/56, 88, 104.04; 118/72, 232, 242

[56] References Cited

U.S. PATENT DOCUMENTS

| | | | |
|---|---|---|---|
| 558,805 | 4/1896 | Gunton, Jr. | 118/232 |
| 2,061,692 | 11/1936 | Bagley | 118/232 X |
| 2,476,299 | 7/1949 | Hirsh | 118/305 |
| 2,685,096 | 8/1954 | Kaye | 15/56 |
| 3,457,576 | 7/1969 | Yarrow | 15/88 X |
| 3,680,165 | 8/1972 | Garst et al. | 15/56 |

*Primary Examiner*—John P. McIntosh
*Attorney, Agent, or Firm*—Brumbaugh, Graves, Donohue & Raymond

[57] ABSTRACT

Apparatus for cleaning and painting gas bottles, comprising a rotatable support plate for supporting the bottle, two rotatable brushes which are movable along the rotating bottle and abut thereon for cleaning the bottle, and a painting implement which also abuts on the bottle and is movable along the rotating bottle for painting it after the cleaning operation. The support plate is tippable for compensating for inaccurate centering of the bottle on the support plate relative to the brushes and the painting implement.

5 Claims, 4 Drawing Figures

APPARATUS FOR CLEANING AND PAINTING GAS BOTTLES

The present invention relates to an apparatus for cleaning and painting gas bottles.

Gas bottles are used to a considerable extent within industry throughout the world for supplying various types of equipment with different sorts of gases, for example, welding equipment with acetylene, oxygen, argon etc. and these gas bottles are filled at special factories or depots, whence they are transported to the consumers and to which they are returned empty. During these delivery and return journeys (and also in handling at either end) the bottles are often subjected to very rough handling so that the paint is scratched off and rust formation later occurs. Consequently, in order to avoid the risk that this rust damage becomes serious, it is necessary that the bottles from time to time be cleaned of rust, dirt and other pollution which may have fastened to them. The bottles are then repainted. This cleaning and painting job has hitherto in the art been effected manually and is, therefore, both expensive and time-consuming. Moreover, this work is unhealthy because of the dust caused in the cleaning operation and of the evaporating solvents in the painting operation.

The object of the present invention is to provide an apparatus for cleaning and painting gas bottles, in which the cleaning and painting operation may be carried out in a much more effective, and thereby cheaper method than previously.

Another object of the present invention is to provide an apparatus of the type disclosed in which the cleaning and painting operations can be carried out without risk to the health of the workers involved.

A further object of the present invention is to provide an apparatus of the type disclosed which is simple in construction and reliable in function.

The present invention and its objects and aspects will be more readily understood from the following description of the drawings, and discussion relating thereto.

Figure 1:
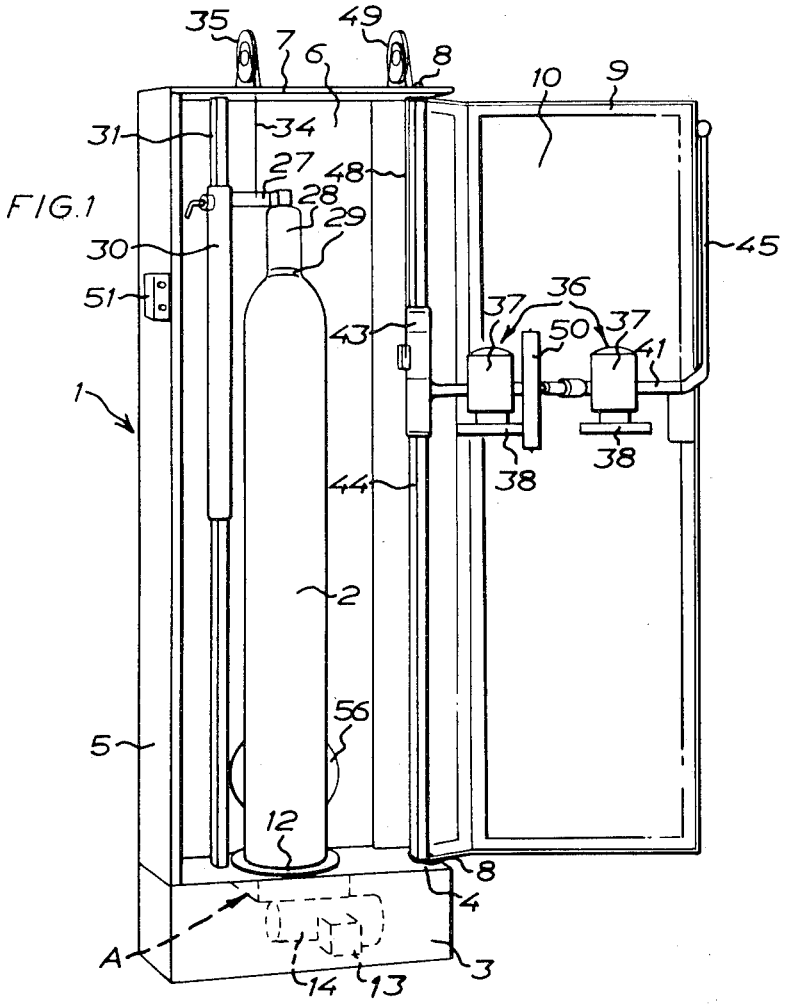
FIG. 1 is a perspective front elevation of the apparatus of the present invention.
Figure 2:
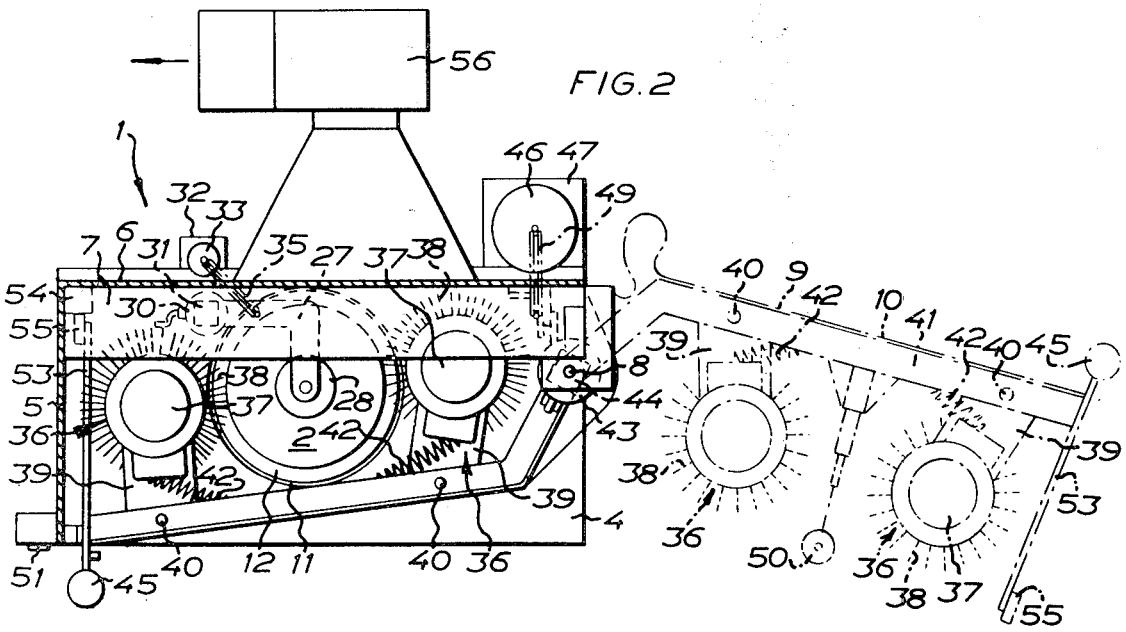
FIG. 2 is a top plan view of the apparatus with a top cover removed.

The reader is now referred to the drawings on which FIGS. 1 and 2 show an apparatus, generally designated 1, for cleaning and painting gas bottles of which one is shown at 2. The apparatus 1 comprises a shed placed on a substrate, for example a floor (not shown) over a hole 3 in the substrate for a purpose which will be described later. Alternatively, the shed can be placed on a foundation with a cavity corresponding to the hole 3. The shed has a base plate 4, a sidewall 5, a rearwall 6, a roof 7 and a door 9 connected to the base plate 4 and roof 7 by means of hinge pins 8. The door is provided with a transparent panel 10 preferably of plexi-glass or the like.

Figure 3:
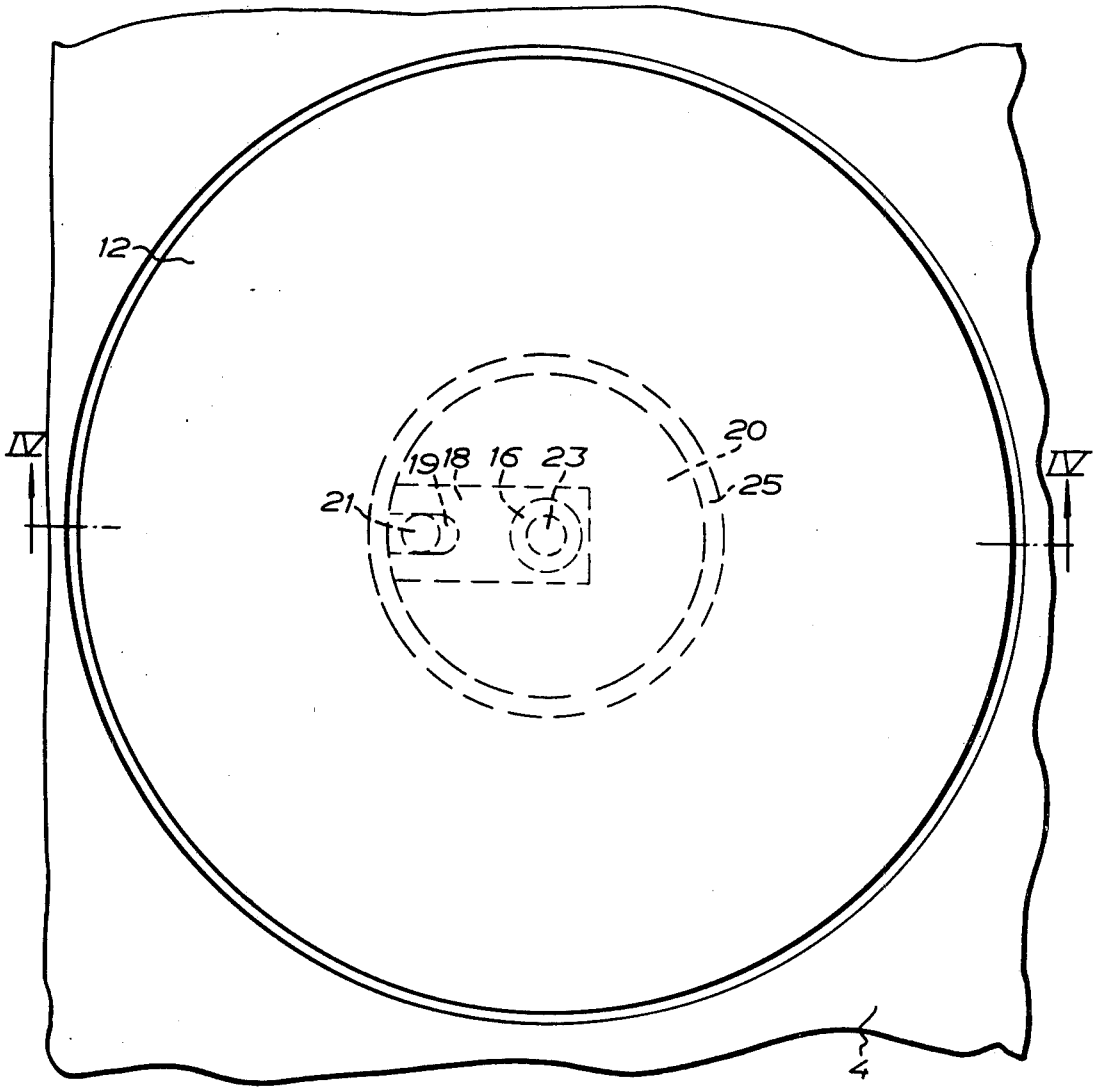
FIG. 3 is a top plan view of a motor-powered, rotary plate at the arrow A in FIG. 1.
Figure 4:
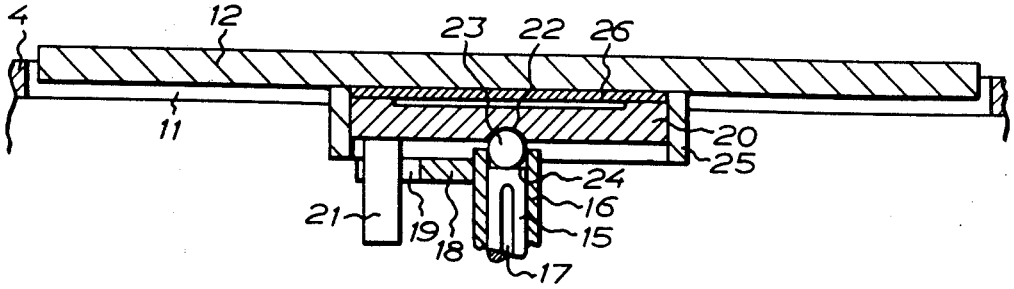
FIG. 4 is a section taken along the line IV—IV of FIG. 3.

A circular recess 11, (FIG. 4) is provided in the base plate 4 for accomodating a circular support plate 12 on which the gas bottle 2 can be placed. The support plate 12 is rotatable by means of an electric motor 13 by the intermediary of a worm gear 14, both the motor 13 and the gear 14 being disposed in the hole 3 in the substrate or alternatively in the cavity in the foundation supporting the shed. The motor 13 and the gear 14 can be combined to a single unit and the output shaft 15 of the gear is connected to the support plate 12 in a manner which will be described below with particular reference to FIGS. 3 and 4.

A sleeve 16 is rotatably mounted by means of a wedge 17 to the upper end of the output shaft 15 of the gear 14 and the sleeve has a radially directed arm 18 fixedly welded thereon and having a groove 19 at its free end. A drive plate 20, which is concentric with the output shaft 15 of the gear 14 and the support plate 12 and is mounted between the shaft 15/sleeve 16 and support plate 12 has, adjacent its outer periphery, a fixedly welded downwardly directed driving pin 21 which extends through the groove 19 of the arm 18, the drive plate 20 being caused to rotate at the same speed as the output shaft 15 because of the abutment of the driving pin 21 against one of the side-walls of the groove 19. The drive plate 20, has on its underside a central, conical recess 22 which forms a seat for a ball 23 between the drive plate and the output shaft 15 of the gear 14. A further seat 24 for the ball 23 is formed in that the sleeve 16 projects up slightly past the free end of the shaft 15. Because of this ball-bearing of the drive plate 20, the plate is tiltable approximately 10° in any direction. The object with this tilting capability will be explained below. In order that the drive plate 20, when it is driven by the shaft 15 by the intermediary of the sleeve 16, the arm 18 and the driving pin 21 in the groove 19 of the arm, does not move out of position concentrically with the shaft 15, it is surrounded by a ring 25 fixedly welded to the underside of the support plate 12. A friction-coating 26 is provided between the upper side of the drive plate 20 and the underside portion of the support plate 12 turned to face the upper side of the drive plate, the coating being retained by glue or in some other suitable fashion on the support plate and allowing the support plate to slip relative to the drive plate if (for reasons which will be described below) a braking force on the support plate exceeds a certain level. Because the support plate 12 is, in principle, lodged freely on the driving plate 20, it is easy to remove and replace.

As was mentioned above, the gas bottle 2 is placed on the support plate 12 for rotation therewith, the speed amounting to about 100 rpm. In order, during this rotation, to guide the upper end of the bottle 2 as well, there is provided a ball-bearing mounted sleeve 28 at one end of an arm 27, the sleeve fitting over the conventional threaded collar ring 29 of the bottle with just a few millimeters play. Since as was mentioned above, the drive plate 20 and the support plate 12 for the bottle 2 are tippable, the sleeve 28 can easily be made to enclose the collar ring 29 even if the bottle is not exactly centered on the support plate. Thanks to the tippable support plate 12, the apparatus 1 can also be used for bottles whose geometric axis is not fully perpendicular to the base plane.

The arm 27 for the sleeve 28 is, at its end distal from the sleeve, fixedy welded or retained by some other suitable means, to a vertical guide tube 30 which is vertically shiftably guided on a spindle 31 mounted within the shed and extending between the base plate 4 thereof and the roof 7. The spindle 31 is fixedly welded or retained in any other suitable fashion to the base plate 4 and is of square profile for non-rotary guiding of the guide tube 30 which, for this purpose, is provided with a sleeve (not shown) with a square hole. In this manner, the height of the arm 27, and thereby that of the sleeve 28, can be adjusted to the height of the bottle and the sleeve 28 can easily be moved down over and away from the collar ring before and after cleaning and painting of the bottle. In order that the sleeve 28 be retained in the adjusted position, the sleeve 28, the arm 27 and the guide tube 30 are balanced by means of a counterweight 33 (FIG. 2) located at the rear side of the shed and vertically movable in a suitable guide 32. The counterweight is connected to the arm via a cable 34 which is passed over a pulley 35 rotatably mounted on the shed.

Two cleaning assemblies 36 are provided for cleaning the bottle 2. These assemblies each consists of an electric motor 37 and a circular steel brush 38 fixed by suitable means (not shown) to the downwardly directed output shaft of the electric motor. Each electric motor 37 is fixedly mounted to the outer free end of a horizontal bracket 39 which, at its other end, is pivotally mounted to a horizontal arm 41 by means of a vertical hinge pin 40. The brackets 39 are biased in a direction towards each other by means of their respective tension spring 42 which at one end is anchored in the associated bracket and, at the other end, is anchored in the arm 41. The pivotability of the brackets 39 in a direction towards and away from each other under the action and against the action of the springs 42 is restricted by contact against abutments (not shown) on the arm 41, FIG. 2 to the right (at the open door 9 shown with dash-dot lines) showing the brackets 39 moved to the maximum position in a direction towards each other.

The horizontal arm 41 is, seen from above, adapted to the configuration of the door 9 and is vertically shiftable in a plane parallel to that of the door. For purposes of this shiftability, the arm 41 supports, at its end proximal the hinge side of the door, a guide sleeve 43 which is slidably guided into a combined door frame portion (defining one upright edge of the door) and a guide of square profile 44. A cam disk (not shown) is fixedly connected to the guide 44 and thus turns with the door 9 on movement thereof. The cam disk cooperates with an extreme limit position switch (not shown) which starts and stops the brush motors 37 on closing and opening of the door 9. The arm 41 has, at its distal end from the hinge edge of the door 9, a vertically directed operating handle 45 by means of which the arm and the electric motors 37 mounted thereon with the steel brushes 38 can be moved manually upwardly and downwardly along the bottle 12 in a manner which will be described below. In order that this manual operation not be too burdensome, the arm 41, the cleaning assemblies 36, the guide sleeve 43 and the handle 45 are balanced by a counterweight 46 mounted at the rear side of the shed and vertically movable in a suitable guide 47 and connected to the guide sleeve 43 via a cable 48 which is passed over a pulley 49 rotatably journaled on the shed.

For painting the bottle 12 after the cleaning operation, the arm 41 in the illustrated embodiment supports a vertically directed paint roller 50 which is placed between the cleaning assemblies 36 and is resiliently shiftable in a direction towards and away from the arm 41. Alternatively, the roller 50 can be mounted above or below the assemblies 36 and can be pivotally connected to the arm in the same manner as the assemblies. As a further alternative, it is conceivable that the operator quite simply paints the bottle by hand by means of a roller or the like.

In the cleaning and painting operation of the bottle, the bottle is, as was mentioned above, placed on the support plate 12 and the sleeve 28 is passed over the collar ring 29 of the bottle. Thereafter, the door 9 and the cleaning assemblies 36 therewith are pivoted from the position shown in FIG. 2 by means of dash-dot lines to a position just ahead of the position shown with solid lines. The bottle 12 is set in rotation via the support plate 12, the drive plate 20, the gear 14 and the motor 13, the motor being started by means of a switch button 51 placed outside the shed. At the same time, the brushes 38 are set in rotation by the start of their associated motors 37 by the intermediary of the extreme limit position switch (not shown) in cooperation with the cam disk on the guide 44. When both the bottle 12 and the brushes 38 are in rotation, the arm 41 and the door 9 are moved further in a direction towards the bottle, whereby the brushes come into contact with the bottle and abut thereagainst with a pressure which is determined by the tension power of the springs 42. For restricting the inward pivoting movement of the arm 41 on the door 9 a projecting arm 53 is provided in the region of the handle 45, the arm 53 supporting at its free end a guide roller 55 which rolls on a guide 54 vertically mounted within the shed. The arm 41 with the cleaning assemblies 36 is then manually moved upwardly and downwardly along the surface of the rotating bottle 12 by means of the handle 45, until such time as rust, dirt and other impurities which may have stuck to the bottle have been thoroughly removed by means of the brushes 38. For preventing the dust which is produced in the cleaning process from escaping into the working premises, the shed is provided at its rear wall 6 with a suction fan 56 which is connected to an exhaust duct (not shown) or the like.

When the cleaning operation is finished, the arm 41 and the door 9 are pivoted outwardly again and the motors 37 of the cleaning assemblies are stopped. The roller 50 is mounted on the arm 41 and supplied with suitable paint. The arm 41 is then pivoted inwardly again so that the roller comes into abutment with the bottle 12 (which is still rotating) whereby the bottle is painted throughout its entire surface in that the arm with the roller is moved by means of a handle 45 upwardly and downwardly along the bottle 12 in the same manner as in the cleaning operation. When the painting operation is complete, the arm 41 is pivoted out to the position shown in FIG. 2 by means of the dash-dot lines, the motor 13 is stopped, the sleeve 28 is lifted from the collar ring 29 and the bottle 12 is removed from the machine, whereafter the machine is ready for a new cleaning and painting cycle.

The invention should not be considered as restricted to the embodiment described above and shown on the drawings, many modifications being possible within the spirit and scope of the accompanying claims.

What I claim and desire to secure by Letters Patent is:

1. Apparatus for cleaning portable gas containers and the like comprising: a rotatable platform adapted to support a gas container, said rotatable platform being slightly tippable with respect to the vertical, motive means for rotating said platform, retainer means for supporting the upper end of a gas container on said rotatable platform against substantial translation while permitting rotation thereof, said retainer means being movable vertically to different positions so as to accommodate gas containers of different sizes to be cleaned, bracket means mounted for swinging movement towards and away from a container supported on said rotatable platform and movable vertically with respect thereto, a pair of laterally spaced apart rotary brushes pivotally mounted on said bracket means for swinging movement towards and away from one another, motive means for driving said rotary brushes, and resilient means normally urging said rotary brushes towards one another, whereby upon swinging said bracket means towards a container on said platform, said rotary brushes engage the container and are moved away from one another in opposition to said resilient means, and upon moving said bracket means vertically with the rotary brushes so positioned the surface of the container can be cleaned.

2. Apparatus for cleaning portable gas containers and the like as defined in claim 1 in which said retainer means comprises a cap of a size to fit the upper end of a container mounted for movement along first vertical guide means, the bracket means is also mounted for movement along second vertical guide means, means is provided for substantially counterbalancing the weight of the retainer means, and means is provided for substantially counterbalancing the weight of the bracket means and the rotary brushes mounted thereon.

3. Apparatus for cleaning portable gas containers and the like as defined in claim 2 together with an enclosure having top, bottom, sides and a door hinged at one side, the rotatable platform being located in the bottom of said enclosure, the door being hinged coaxially with said second vertical guide means, and the bracket means being movable with the door towards and away from the interior of said enclosure.

4. Apparatus for cleaning portable gas containers and the like as defined in claim 3 together with cooperating guide and follower means on the enclosure and on the bracket means for limiting inward movement of the latter as the rotary brushes are moved along a container supported on the rotatable platform in cleaning engagement therewith.

5. Apparatus for cleaning portable gas containers and the like as defined in claim 1 together with means carried by said bracket means for applying a coating to a container supported on said rotatable platform.

* * * * *